US009962012B1

(12) United States Patent
Schmid et al.

(10) Patent No.: US 9,962,012 B1
(45) Date of Patent: May 8, 2018

(54) INFANT SLEEP DEVICE

(71) Applicant: HALO INNOVATIONS, INC., Minnetonka, MN (US)

(72) Inventors: William Schmid, Plymouth, MN (US); Patrick Brown, Auburn, OH (US); William Rabbitt, Chesterland, OH (US); Carolyn McNeeley, University Heights, OH (US)

(73) Assignee: HALO INNOVATIONS, INC., Minnetonka, MN (US)

( * ) Notice: Subject to any disclaimer, the term of this patent is extended or adjusted under 35 U.S.C. 154(b) by 416 days.

(21) Appl. No.: 14/142,129

(22) Filed: Dec. 27, 2013

Related U.S. Application Data

(60) Provisional application No. 61/746,670, filed on Dec. 28, 2012.

(51) Int. Cl.
*A47D 7/02* (2006.01)
*A47D 9/00* (2006.01)

(52) U.S. Cl.
CPC ..... *A47D 9/00* (2013.01)

(58) Field of Classification Search
CPC ..... A47D 9/005; A47D 9/00; A47D 13/063; A47D 7/002
USPC .... 5/93.1, 93.2, 95, 98.1, 99.1, 100; 482/95, 482/96
See application file for complete search history.

(56) References Cited

U.S. PATENT DOCUMENTS 248,121 A * 10/1881 Tuttle ..... 482/96
2,299,136 A * 10/1942 Feldman ..... 5/11
2,599,296 A * 6/1952 Toomey et al. ..... 5/11
2,870,461 A * 1/1959 Rosenthal ..... A47D 13/06 229/114
2,870,462 A * 1/1959 Turrin et al. ..... 5/99.1
2,873,455 A * 2/1959 Davis ..... 5/93.1
3,195,152 A * 7/1965 Gottlieb ..... 5/99.1
3,789,439 A * 2/1974 Berg et al. ..... 5/99.1
4,571,760 A * 2/1986 Kassai ..... 5/99.1
5,269,591 A * 12/1993 Miga, Jr. ..... A47D 13/107 297/16.1
5,411,315 A * 5/1995 Greenwood ..... A47D 13/107 297/440.11

(Continued)

FOREIGN PATENT DOCUMENTS

WO WO2010/090753 8/2010

OTHER PUBLICATIONS https://www.youtube.com/watch?v=IzZQRebDbl4 , DMailorinliespir1978, Apr. 15, 2015.*

*Primary Examiner* — David E Sosnowski
(74) *Attorney, Agent, or Firm* — Hamre, Schumann, Mueller & Larson, P.C.

(57) ABSTRACT

A sleep device for newborns and infants that provides a separate but proximate sleep area near a caregiver or parent's bed and at the same level the caregiver is sleeping at for increased visibility of infant and easier access to the infant without the need for the parent to leave their own bed. The sleep device allows for more convenient access to the infant, better ability to soothe and comfort the infant thru close, yet safe contact, and easier access and egress to the adult bed. The sleep device can include a bumper that slopes downwardly in a direction from a rear bumper portion to a front bumper portion so that a rear side wall portion has a vertical height that is greater than a vertical height of a front side wall portion.

12 Claims, 11 Drawing Sheets

(56) References Cited

U.S. PATENT DOCUMENTS

| | | | | |
|---|---|---|---|---|
| 5,699,569 | A * | 12/1997 | Schwarz-Zohrer | A47D 1/02 297/DIG. 3 |
| 5,957,436 | A * | 9/1999 | Ristau | 256/25 |
| D617,056 | S * | 6/2010 | Zine | D30/118 |
| 8,627,520 | B1 * | 1/2014 | Morton | 5/99.1 |
| 2002/0002741 | A1 * | 1/2002 | Tomas | A47D 13/107 5/101 |
| 2003/0046761 | A1 * | 3/2003 | Hsia | 5/99.1 |
| 2006/0117478 | A1 * | 6/2006 | Cheung | 5/99.1 |
| 2006/0208545 | A1 * | 9/2006 | Cornelia | A47C 31/11 297/219.12 |
| 2009/0106894 | A1 * | 4/2009 | Yeo | A47D 15/008 5/93.1 |
| 2009/0284058 | A1 * | 11/2009 | Gillett | A47D 13/105 297/258.1 |
| 2010/0199426 | A1 * | 8/2010 | Long | 5/100 |
| 2010/0263121 | A1 * | 10/2010 | Arnold et al. | 5/98.1 |
| 2011/0113548 | A1 * | 5/2011 | Thomsen et al. | 5/93.1 |
| 2011/0113549 | A1 * | 5/2011 | Riddiford et al. | 5/95 |
| 2012/0317716 | A1 * | 12/2012 | Tricault et al. | 5/99.1 |
| 2013/0145546 | A1 * | 6/2013 | Cheng | 5/93.1 |
| 2013/0185867 | A1 * | 7/2013 | Long | 5/95 |
| 2014/0059762 | A1 * | 3/2014 | Bonczek | 5/98.1 |

* cited by examiner

INFANT SLEEP DEVICE

FIELD

This disclosure relates to a means to make it safer and easier to sleep close to your baby (as recommended by health professionals), a means to make it easier for a parent to get in and out of their bed when sleeping close to their baby and a means for bringing a baby into a parent's sleep space to facilitate breastfeeding or soothing.

SUMMARY

This disclosure describes improvements on the traditional bassinet typically used for newborns and infants to provide a separate, but proximate sleep area near a caregiver or parent's bed and at the same level the caregiver is sleeping at for increased visibility of infant and easier access to infant without the need for the parent to leave their own bed. The improvements allow for more convenient access to the infant, better ability to soothe and comfort the infant thru close, yet safe contact, and easier access and egress to the adult bed.

In one embodiment, an infant sleep device includes a floor including a front floor portion and a rear floor portion. A side wall extends upwardly from the floor to define an infant sleep space. The side wall includes a front side wall portion connected to and extending upwardly from the front floor portion, and a rear side wall portion connected to and extending upwardly from the rear floor portion. A bumper is connected to an upper edge of the side wall, with the bumper including a front bumper portion connected to the front side wall portion and a rear bumper portion connected to the rear side wall portion. The bumper slopes downwardly in a direction from the rear bumper portion to the front bumper portion so that the rear side wall portion has a vertical height that is greater than a vertical height of the front side wall portion.

In another embodiment, the front wall portion and the front bumper portion are movable between a raised position and a fully lowered position, and at the fully lowered position the front bumper portion is disposed at a vertical position above the level of the floor. This helps retain an infant within the sleep space of the sleep device. In addition, the front wall portion and the front bumper portion are resiliently biased toward the raised position so that the front wall portion and the front bumper portion are automatically returned to the raised position when a force that moves the front wall portion and the front bumper portion to the fully lowered position is removed.

In another embodiment, a stop mechanism can be provided that limits downward movement of the front wall portion and the front bumper portion and stops the front wall portion and the front bumper portion at the fully lowered position.

In still another embodiment, a linkage mechanism is provided between the floor and the front wall portion and the front bumper portion. The linkage mechanism is configured to raise the floor upward as the front wall portion and the front bumper portion are lowered to the fully lowered position.

DRAWINGS

DETAILED DESCRIPTION

Figure 1:
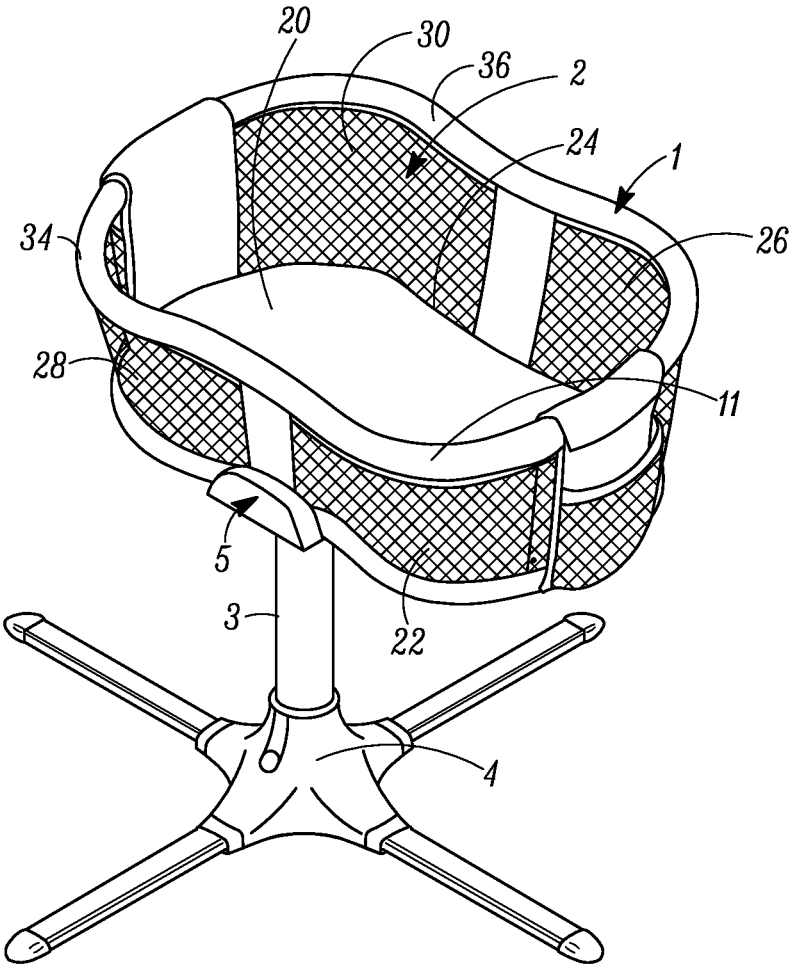
FIG. 1 is a perspective view of an infant sleep device described herein according to one embodiment.

With reference to FIG. 1, a bassinet-like, infant sleep device 1 is illustrated that is attached to a rotating, adjustable-height tower 3 and base 4. The device includes a floor 20 that includes a front floor portion or edge 22 and a rear floor portion or edge 24. A side wall 2 extends upwardly from the floor 20 to define an infant sleep space 26. The side wall 2 includes a front side wall portion 28 connected to and extending upwardly from the front floor portion 22, and a rear side wall portion 30 connected to and extending upwardly from the rear floor portion 24.

Figure 3:
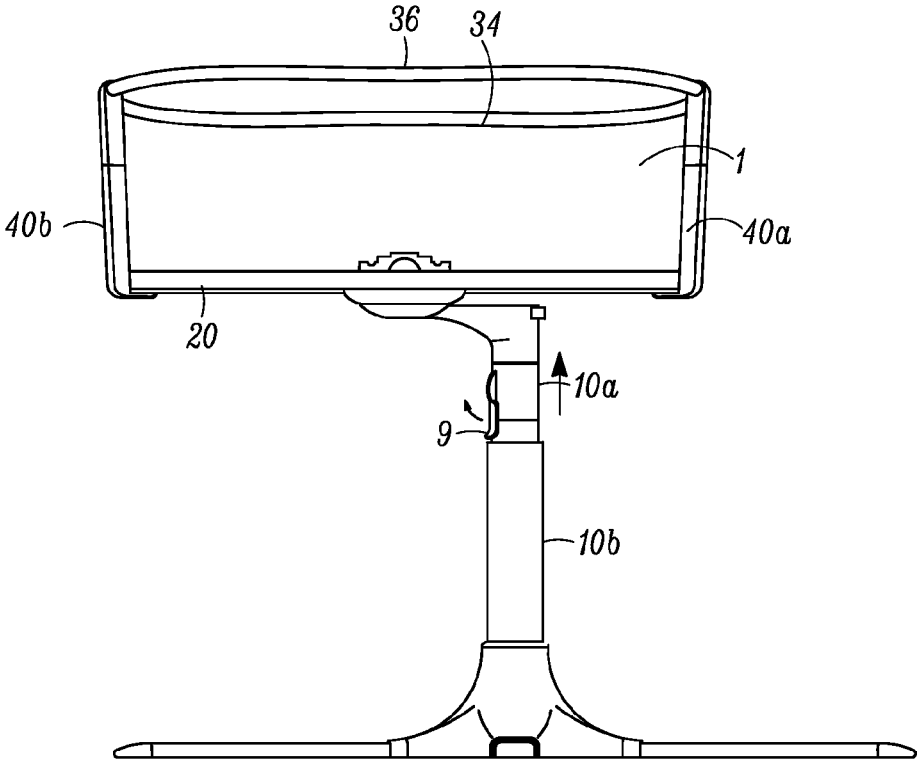
FIG. 3 is a side view of the infant sleep device.
Figure 4:
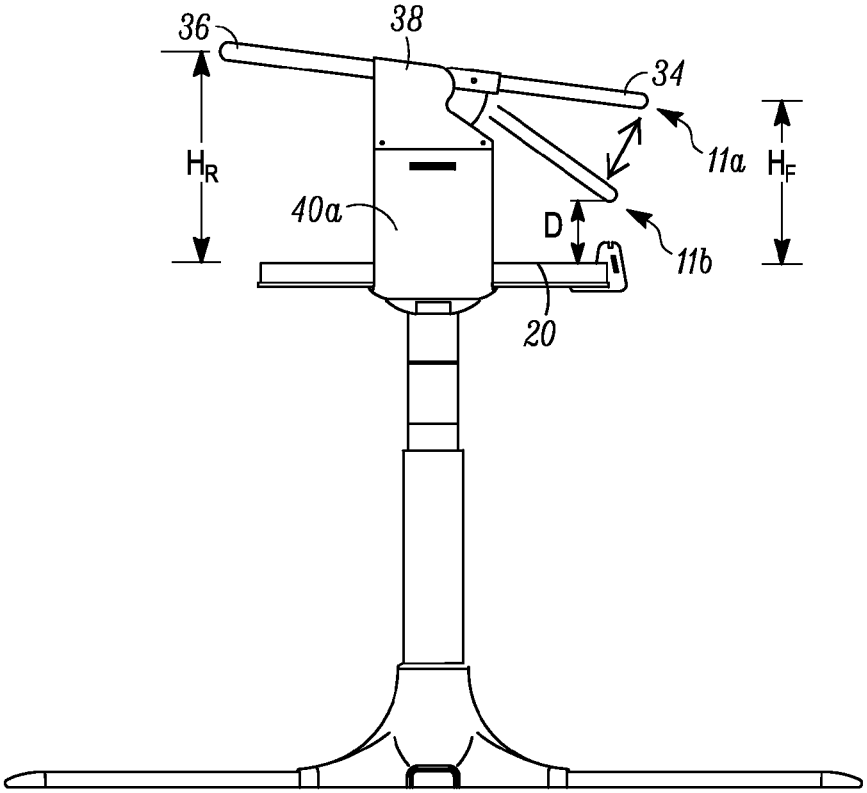
FIG. 4 is an end view of the infant sleep device.
Figure 5:
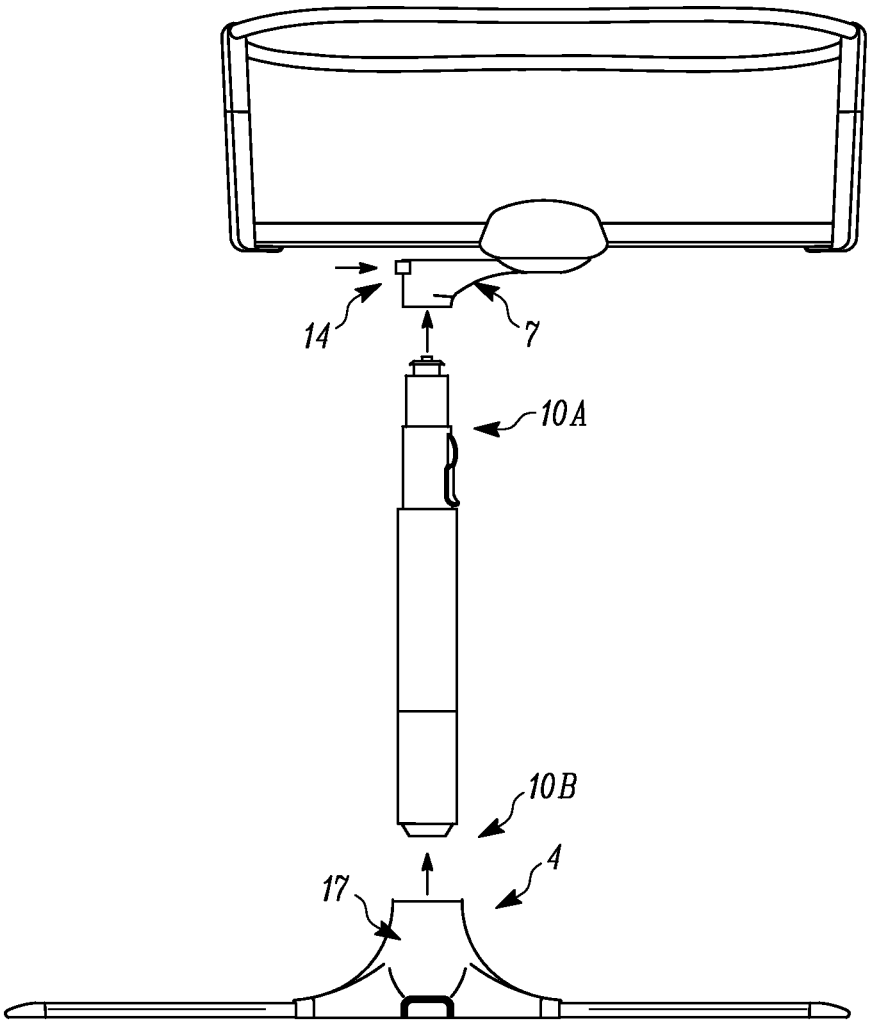
FIG. 5 is another side view of the infant sleep device.

A bumper 32 is connected to an upper edge of the side wall 2. The bumper 32 includes a front bumper portion 34 connected to the front side wall portion 28 and a rear bumper portion 36 connected to the rear side wall portion 30. As best seen in FIGS. 3 and 4, the bumper 32 slopes downwardly in a direction from the rear bumper portion 36 to the front bumper portion 34 so that the rear side wall portion 30 has a vertical height $H_R$ that is greater than a vertical height $H_F$ of the front side wall portion 28. In FIGS. 3-5, the side wall 2 and the side wall portions 28, 30 have been removed for clarity.

With reference to FIG. 4, the front wall portion 28 and the front bumper portion 34 are movable in the directions of the arrows between a raised position 11*a* and a fully lowered position 11*b*. To permit movement, the front bumper portion 34 is pivotally connected to the rear bumper portion 36. At the fully lowered position 11*b*, the front bumper portion 34 is disposed at a vertical position/space D above the level of the floor. By maintaining a distance D above the floor 20, the infant is prevented from rolling out of the sleep device, for example if for some reason the front wall portion 28 and the front bumper portion 34 fail to return to the raised position 11*a*. In addition, the front wall portion 28 and the front bumper portion 34 are resiliently biased toward the raised position 11*a* so that the front wall portion and the front bumper portion are automatically returned to the raised position 11*a* when a force that moves the front wall portion and the front bumper portion to the fully lowered position 11*b* is removed. US 2010/0199426 discloses examples of how a front wall can be biased to return to a raised position. The front wall portion 28 and the front bumper portion 34 may be lowered by, for example, a mother or other caregiver resting their arms on the front bumper portion 34.

With continued reference to FIG. 4, a stop mechanism 38 can be provided that limits the downward movement of the front wall portion 28 and the front bumper portion 34 and stops the front wall portion and the front bumper portion at the fully lowered position 11*b*. In the example illustrated in FIG. 4, the stop mechanism 38 comprises a shoulder formed on at least one vertical support 40*a*, 40*b* that supports the bumper above the floor 20 and against which the front bumper portion 34 abuts when it moves downward.

In addition, as described below with respect to FIGS. 6A-C, a linkage mechanism can be provided between the floor 20 and the front wall portion 28 and the front bumper portion 34, where the linkage mechanism is configured to raise the floor 20 upward as the front wall portion and the front bumper portion are lowered to the fully lowered position 11*b*.

The side wall 2 of the infant sleep device 1 may be configured to aid in airflow and visibility of the infant when sleeping. For example, some or all of the side wall may be made of mesh material. In addition, it is contemplated that a control panel 5 that controls soothing sounds, a night light, vibration or other useful functions could be mounted conveniently on the front of the infant sleep device 1. A specific function that could provide additional safety is a countdown timer that a mother could activate when she begins to breastfeed her child which would alarm in some fashion after an interval of time to remind the mother to return her infant to the safety of the infant sleep device. The countdown timer could be activated when the front wall portion 28 and front bumper portion 34 are lowered (for example when the baby is removed for feeding) or when a night light is turned on. The timer could be de-activated by a second lowering of the front wall portion/front bumper portion (for example when the baby is returned to the sleep space 26 or when the night-light is turned off.

It is contemplated that the infant sleep device 1 can be removed from the tower 3 and used as a portable bassinet.

It is also contemplated that the walls of the infant sleep space 1 could have openings or utilize a mesh fabric for easier viewing of the child when asleep. Any fabric lining the infant sleep device will be removable for laundering.

Figure 2:
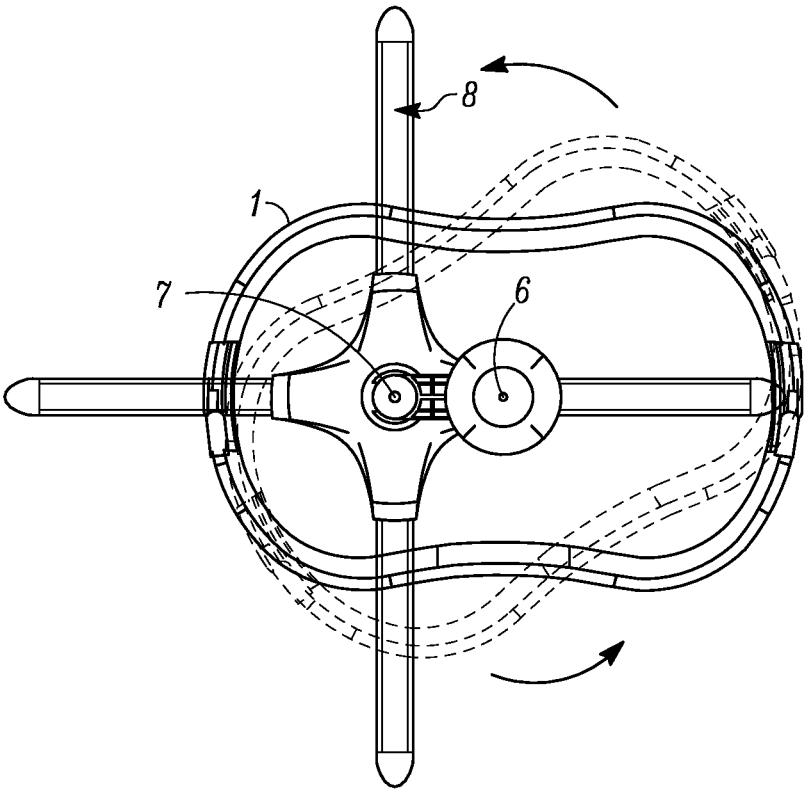
FIG. 2 is a top view of the infant sleep device showing rotation of the sleep device.

Additional embodiments contemplate that the infant sleep device could have a rocking or bouncing mechanism (manual or automated) for soothing the infant, a night light for better visibility, a nursing timer to remind a mother to return the infant to the sleep space 26 once nursing is completed, a storage bin or enclosure attached to the infant sleep device or the tower, or a cup-holder or shelf attached to the tower adjacent to the infant sleep device for additional convenience With reference to FIG. 2, the infant sleep device 1 can be mounted on a rotating pivot 6 on the end of an articulating, rotating arm 7 of the tower 3 to give increased flexibility in positioning the infant sleep device 1 next to a sleeping parent. The base 4 can include legs 8 that are sufficiently long to provide a stable, tip-proof design while not interfering with the traffic pattern around an adult bed. In one embodiment, the infant sleep device 1 can have an hourglass shape designed to allow easier access to the infant by contouring to the parent's body when sitting or standing next to the sleeper.

With reference to FIG. 3, the tower 3 is adjustable up and down to adjust the infant sleep device 1 up or down to align with the adult bed's sleep surface height. The tower 3 may include an upper tower 10*a* that slides into a concentric, lower tower 10*b* with a latch or brake mechanism 9 which allows for infinite, incremental height adjustments.

With reference to FIG. 4, the front side wall portion 28 and the front bumper portion 34 facing the caregiver can be lowered 11*b* to facilitate access to the infant in the infant sleep device. As discussed above, this wall can only be forcibly lowered a certain distance in order to maintain the distance D which is the minimum height allowed by law and will be restored to its normal height 11*a* when the lowering force is removed.

With reference to FIG. 6, the articulating, rotating arm 7 can be locked from rotating by a locking mechanism 14. This arm can also be removably attached to the upper tower 10*a*. The lower tower 10*b* can also be removably attached to the base 4 to facilitate easier storage and portability. Latching mechanisms 14, 17 allow for tool-free assembly and dis-assembly.

Figure 6A:
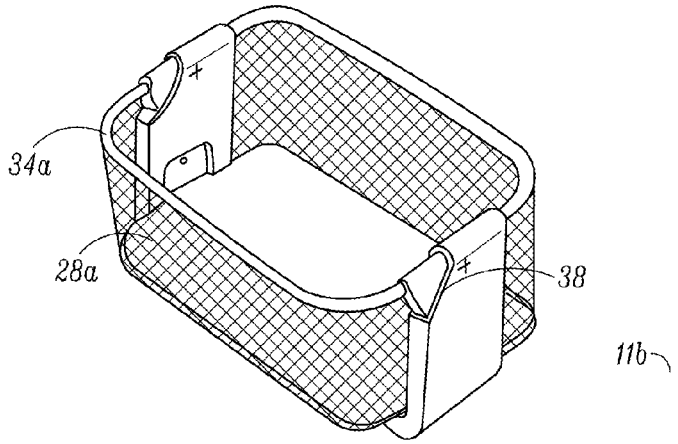
FIG. 6A is a perspective view of another embodiment of an infant sleep device described herein.
Figure 6B:
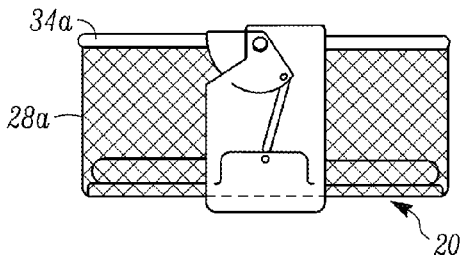
FIGS. 6B and 6C are end views of the infant sleep device of FIG. 6A illustrating pivoting movement of one wall and a stop mechanism.
Figure 6C:
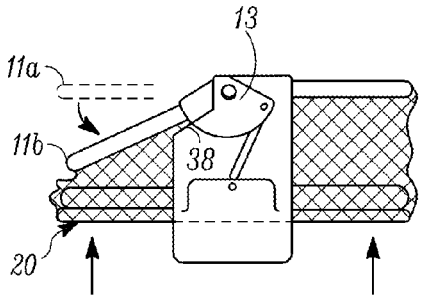

With reference to FIGS. 6A-C, the front side wall portion 28*a* and the front bumper portion 34*a* can be connected to the floor 20 by a linkage mechanism 13 so that, when lowered to the lowered position 11*b*, the floor 20 of the sleep device 1 would be raised upwardly as indicated by the arrows. The baby's weight would lower the floor 20 and return the front side wall portion/front bumper portion to the raised position 11*a*.

Figure 7B:
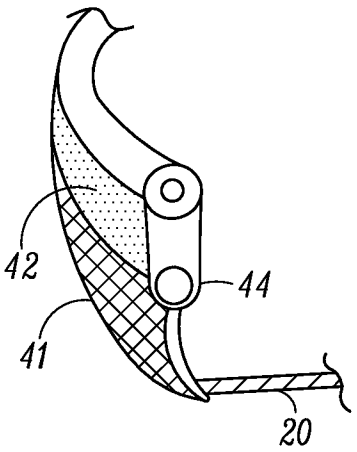
FIG. 7B is a detailed, cross-sectional view taken through line B-B of FIG. 7A.
Figure 7A:
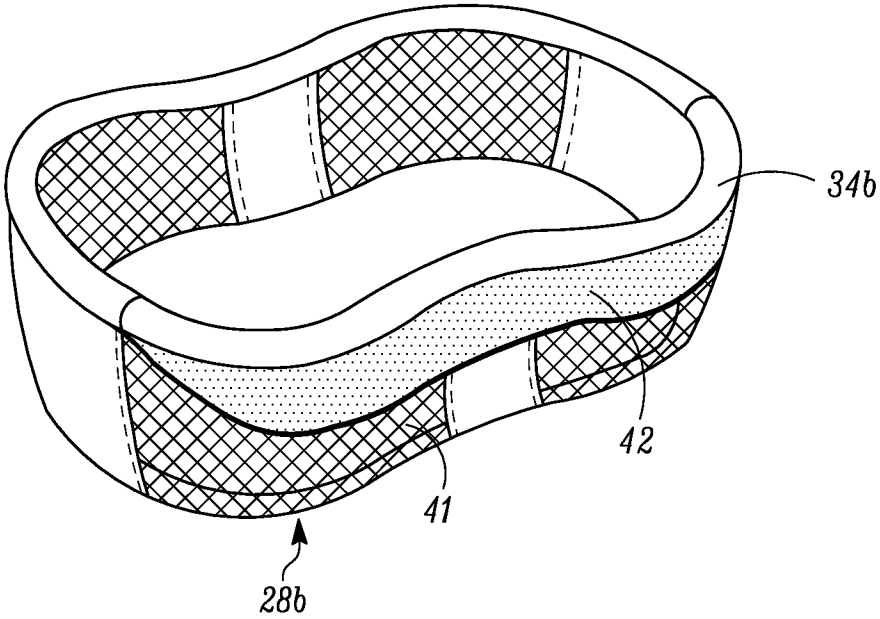
FIG. 7A is a perspective view of another embodiment of an infant sleep device.

With reference to FIGS. 7A and 7B, some or all of the front side wall portion 28*b* can be made of a resilient material, such as compressible foam, so that a caregiver can push the foam down with their forearms to make it easier to scoop up or return and infant to the sleep space 26, and the wall will return to its intended use height when the force is removed. In this example, some of the front wall portion 28 at a base thereof 41 is made of mesh, while an upper portion 42 is made of the resilient material. Structural tubing 44 can be disposed between the base portion 41 and the upper portion 42. In addition, the front bumper portion 34*b* can be made of pliable foam.

Figure 8B:
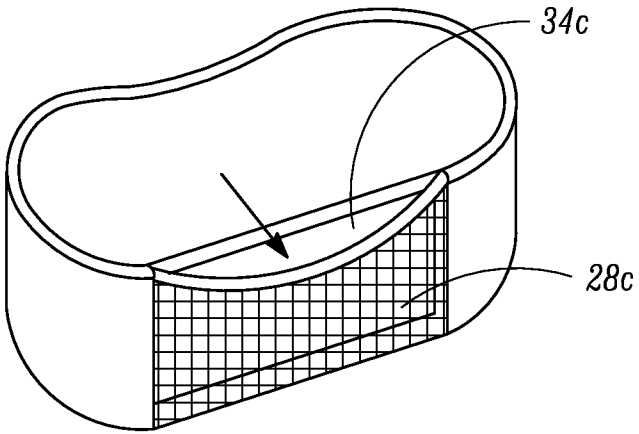
FIGS. 8A and 8B illustrate another embodiment of an infant sleep device.
Figure 8A:
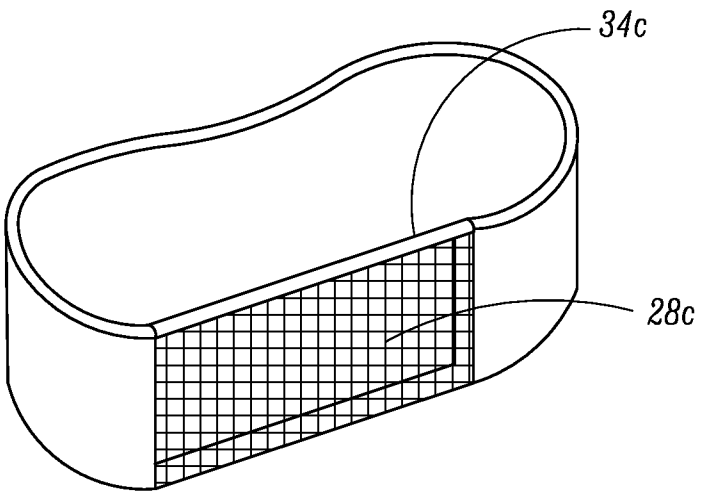

With reference to FIGS. 8A and 8B, an embodiment is illustrated where the front bumper portion 34*c* is made of an elastic material, such as an elastic cord, while the front side wall portion 28*c* is made of mesh material, so that a caregiver can push the cord down with their forearms to make it easier to scoop up or return and infant to the sleep space 26, and the wall will return to its intended use height when the force is removed.

Figure 9B:
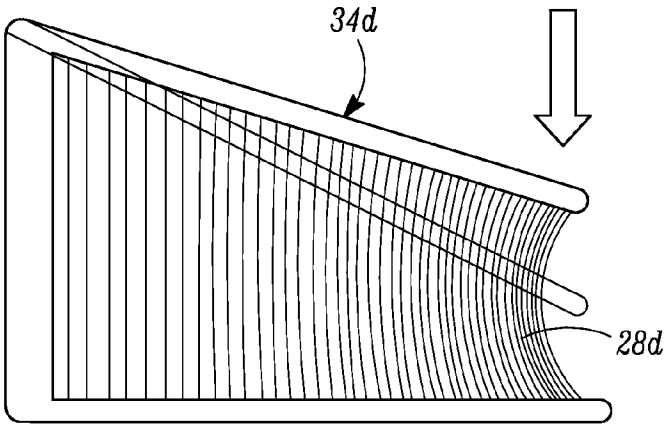
FIGS. 9A and 9B are perspective and end views, respectively, of another embodiment of an infant sleep device.
Figure 9A:
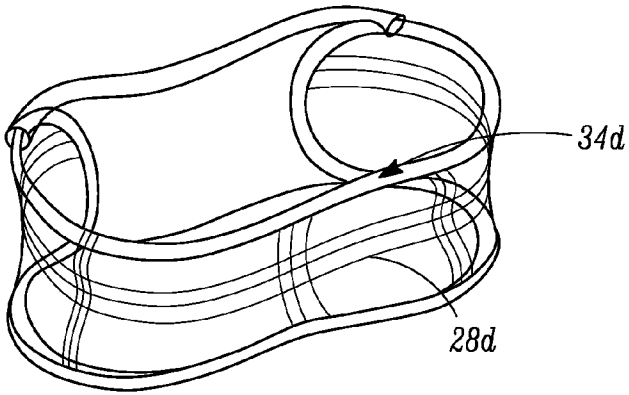

With reference to FIGS. 9A and 9B, an embodiment is illustrated whereby the front side wall portion 28*d* is made of a resilient material, such as spring steel or an elastomer, so that a caregiver can push the wall down with their forearms to make it easier to scoop up or return and infant to the sleep space 26, and the wall will return to its intended use height when the force is removed.

Figure 10:
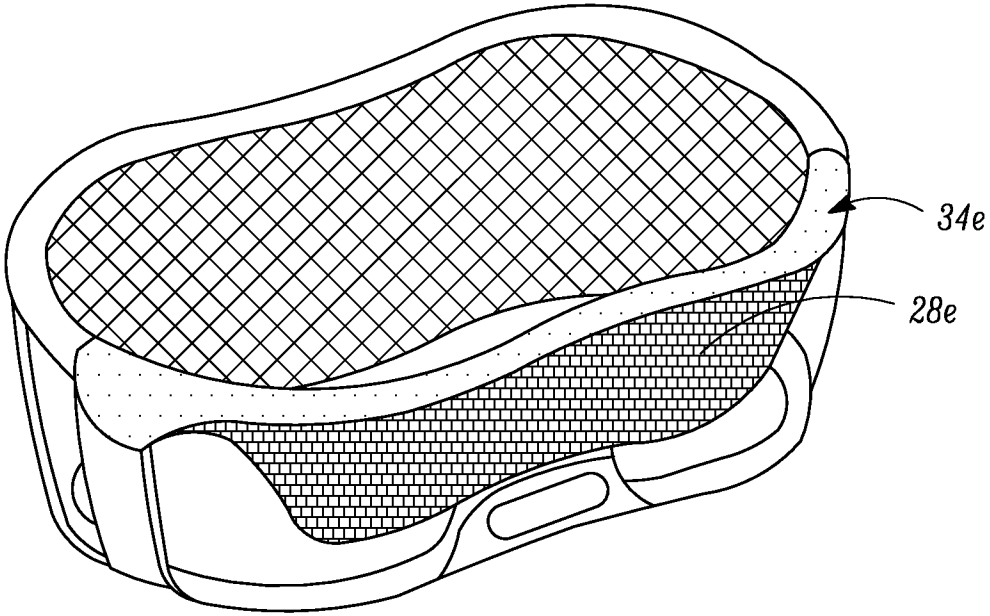
FIG. 10 is a perspective view of another embodiment of an infant sleep device.

With reference to FIG. 10, an embodiment is illustrated where the front side wall portion 28*e* is made of a resilient material, such as an elastomeric plastic, so that a caregiver can push the wall down with their forearms to make it easier to scoop up or return and infant to the sleep space 26, and the wall will return to its intended use height when the force is removed.

Figure 11A:
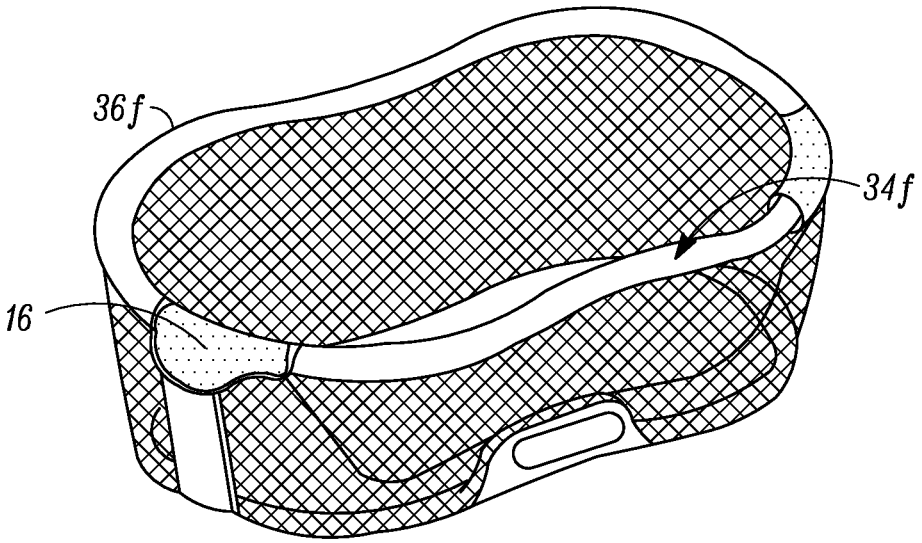
FIGS. 11A and 11B are perspective views of another embodiment of an infant sleep device.
Figure 11B:
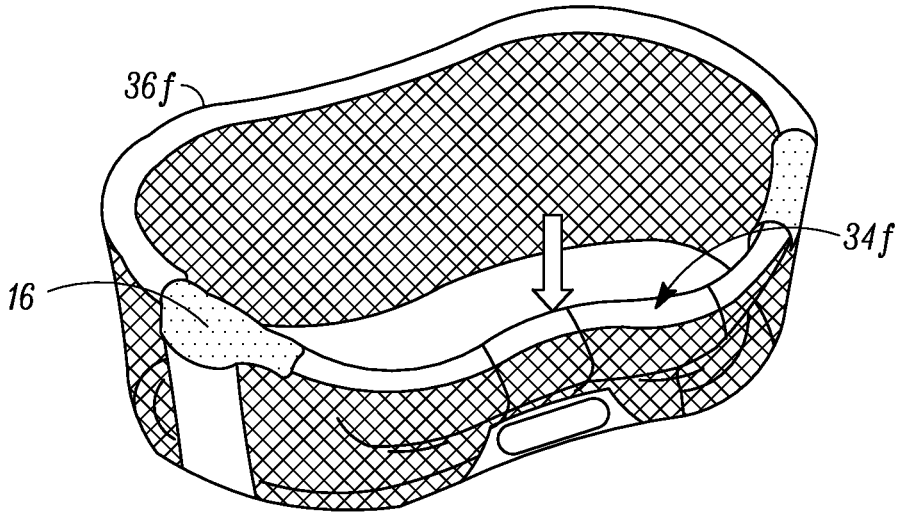

With reference to FIGS. 11A and 11B, an embodiment is illustrated where the front bumper portion 34*f* is made of a non-resilient material that is attached to the rear bumper portion 36*f* by a flexible material 16 that allows the caregiver to push the wall down with their forearms to make it easier to scoop up or return and infant to the sleep space 26, and the wall will return to its intended use height when the force is removed.

The invention claimed is:

1. A bassinet comprising:

a floor including a front edge, a rear edge, a first end, a second end, and a longitudinal axis between the first end and the second that is generally parallel to the front edge and to the rear edge;

a side wall extending upwardly from the floor to define an infant sleep space, the side wall includes a front side wall portion connected to and extending upwardly from the front edge, and a rear side wall portion connected to and extending upwardly from the rear edge, and the front side wall portion and the rear side wall portion are generally parallel to the longitudinal axis over the majority of a length of the front side wall portion and the rear side wall portion;

a bumper connected to an upper edge of the side wall, the bumper includes a front bumper portion connected to the front side wall portion and a rear bumper portion connected to the rear side wall portion;

the front bumper portion and the front side wall portion are movable together relative to the rear bumper portion and the rear side wall portion between a raised position and a fully lowered position;

the bumper slopes downwardly in a direction from the rear bumper portion to the front bumper portion so that the rear side wall portion has a vertical height, measured from the floor of the bassinet to the rear bumper portion, that is greater than a vertical height, measured from the floor of the bassinet to the front bumper portion, of the front side wall portion at each of the raised position and the fully lowered position.

2. The bassinet of claim 1, wherein at the fully lowered position the front bumper portion is disposed at a vertical position above the level of the floor; and the front side wall portion and the front bumper portion are resiliently biased toward the raised position so that the front side wall portion and the front bumper portion are automatically returned to the raised position when a force that moves the front side wall portion and the front bumper portion to the fully lowered position is removed.

3. The bassinet of claim 2, further comprising a stop mechanism that limits downward movement of the front side wall portion and the front bumper portion and stops the front side wall portion and the front bumper portion at the fully lowered position.

4. The bassinet of claim 2, further comprising a linkage mechanism between the floor and the front side wall portion and the front bumper portion, the linkage mechanism is configured to raise the floor upward as the front side wall portion and the front bumper portion are lowered to the fully lowered position.

5. A bassinet comprising:

a floor including a front edge, a rear edge, a first end, a second end, and a longitudinal axis extending between the first end and the second end;

a side wall extending upwardly from the floor of the bassinet to define an infant sleep space, the side wall includes a front side wall portion connected to and extending upwardly from the front edge, and a rear side wall portion connected to and extending upwardly from the rear edge, and the front side wall portion and the rear side wall portion extend the entire length of the floor from the first end to the second end;

a bumper connected to an upper edge of the side wall, the bumper includes a front bumper portion connected to the front side wall portion and a rear bumper portion connected to the rear side wall portion; and the front side wall portion and the front bumper portion are movable relative to the rear side wall portion and the rear bumper portion between a raised position and a fully lowered position, and at the fully lowered position the front bumper portion is disposed at a vertical position above the level of the floor of the bassinet; and the front side wall portion and the front bumper portion are resiliently biased toward the raised position so that the front side wall portion and the front bumper portion are automatically returned to the raised position when a force that moves the front side wall portion and the front bumper portion to the fully lowered position is removed.

6. The bassinet of claim 5, further comprising a stop mechanism that limits downward movement of the front side wall portion and the front bumper portion and stops the front side wall portion and the front bumper portion at the fully lowered position.

7. The bassinet of claim 5, further comprising a linkage mechanism between the floor and the front side wall portion and the front bumper portion, the linkage mechanism is configured to raise the floor upward as the front side wall portion and the front bumper portion are lowered to the fully lowered position.

8. The bassinet of claim 5, wherein the floor has an hour-glass shape.

9. A bassinet comprising:

a floor including a front edge, a rear edge, a first end, a second end, and a longitudinal axis extending between the first end and the second end;

a side wall extending upwardly from the floor to define an infant sleep space, the side wall includes a front side wall portion connected to and extending upwardly from the front edge, and a rear side wall portion connected to and extending upwardly from the rear edge, and the front side wall portion and the rear side wall portion extend the entire length of the floor from the first end to the second end;

a bumper connected to an upper edge of the side wall, the bumper includes a front bumper portion connected to the front side wall portion and a rear bumper portion connected to the rear side wall portion;

the front side wall portion and the front bumper portion are movable relative to the rear side wall portion and the rear bumper portion between a raised position and a fully lowered position, and at the fully lowered position the front bumper portion is disposed at a vertical position above the level of the floor; and the front side wall portion and the front bumper portion are resiliently biased toward the raised position so that the front side wall portion and the front bumper portion are automatically returned to the raised position when a force that moves the front side wall portion and the front bumper portion to the fully lowered position is removed; and at the raised position, the bumper slopes downwardly in a direction from the rear bumper portion to the front bumper portion and the rear side wall portion has a vertical height, measured from the floor of the bassinet to the rear bumper portion, that is greater than a vertical height, measured from the floor of the bassinet to the front bumper portion, of the front side wall portion.

10. The bassinet of claim 9, further comprising a stop mechanism that limits downward movement of the front side wall portion and the front bumper portion and stops the front side wall portion and the front bumper portion at the fully lowered position.

11. The bassinet of claim 9, further comprising a linkage mechanism between the floor and the front side wall portion and the front bumper portion, the linkage mechanism is configured to raise the floor upward as the front side wall portion and the front bumper portion are lowered to the fully lowered position.

12. The bassinet of claim 9, wherein the floor has an hour-glass shape.

* * * * *